US006981288B1

(12) United States Patent
Hu

(10) Patent No.: US 6,981,288 B1
(45) Date of Patent: Jan. 3, 2006

(54) STRUCTURE OF A PILLOW

(75) Inventor: Mei Hui Hu, Tainan (TW)

(73) Assignee: Her Chian Acrylic Co., Ltd., Tainan (TW)

( * ) Notice: Subject to any disclaimer, the term of this patent is extended or adjusted under 35 U.S.C. 154(b) by 0 days.

(21) Appl. No.: 10/958,422

(22) Filed: Oct. 6, 2004

(51) Int. Cl.
*A47G 9/00* (2006.01)

(52) U.S. Cl. ..... 5/636; 5/640

(58) Field of Classification Search ..... 5/636, 5/640, 645, 644
See application file for complete search history.

(56) References Cited

U.S. PATENT DOCUMENTS

| | | | | |
|---|---|---|---|---|
| 3,243,828 | A * | 4/1966 | McCarty | 5/636 |
| 4,908,894 | A * | 3/1990 | Sanders | 5/640 |
| 5,168,590 | A * | 12/1992 | O'Sullivan | 5/490 |
| 5,809,594 | A * | 9/1998 | Isogai | 5/645 |
| 6,671,906 | B1 * | 1/2004 | Milligan | 5/636 |

* cited by examiner

*Primary Examiner*—Alexander Grosz
(74) *Attorney, Agent, or Firm*—Rosenberg, Klein & Lee

(57) ABSTRACT

A pillow includes a main support part, two secondary support parts, several mats, and a bag for housing the supports and the mats therein; the main support part is used for supporting the neck and the head of a person sleeping on the back; the secondary support parts are positioned on two sides of the main support part, used for supporting the neck and the head of a user who is sleeping on one side; a suitable number of mats are positioned under the support parts for changing the heights of the support parts according to the need of the user.

3 Claims, 6 Drawing Sheets

STRUCTURE OF A PILLOW

BACKGROUND OF THE INVENTION

1. Field of the Invention

The present invention relates to a pillow, more particularly one, which can be adjusted in height such that the user's head and neck can be comfortably supported in proper position thereon, protecting the user from having a stiff neck.

2. Brief Description of the Prior Art

The shape of a pillow is one of the factors in sleep quality. Manufacturers have been working to develop various forms of pillows, taking into consideration the relative position between the head and the neck as well as the length of one shoulder, such that the pillows can that fit ergonomics, capable of supporting a user's head and neck in proper position not only when the user is sleeping on one side, but also when the user is sleeping on the back.

Referring to FIG. 1, a conventional pillow 1 includes a main support portion 11, and secondary support portions 12 on two sides of the main support portion 11. The main support portion 11 has a convex protrusion 111, and a lower portion 112 next to the convex protrusion 111, which are respectively used for supporting the neck and the head of a user on who is sleeping on the back. The secondary support portions 12 are used when the user is sleeping on one side, and they are made such that their height is equal to the average length of people's shoulders for the user's neck and head to be comfortably supported in proper position.

The above pillow has disadvantages as followings:

1. Because people have different body sizes, and the pillow can't be adjusted in the height, the pillow can't suit all consumers.

2. The pillow can't be restored to the original height after it becomes thin because of use for a certain period of time, incapable of supporting the user's head and neck thereon in the proper position any more. Consequently, the pillow has to be discarded. In other words, the pillow isn't economical to use.

SUMMARY OF THE INVENTION

It is a main object of the present invention to provide an improvement on a pillow to overcome the above disadvantages.

The pillow of the present invention includes a main support part, two secondary support parts, several mats, and a bag for housing the supports and the mats therein. The main support part is used for supporting the neck and the head of a user who is sleeping on the back. The secondary support parts are positioned on two sides of the main support part, used for supporting the neck and the head of a user who is sleeping on one side. The mats are positioned under the support parts for adjusting the heights of the support parts with; thus, the user can have his neck and head supported in proper position, protected from having a stiff neck.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
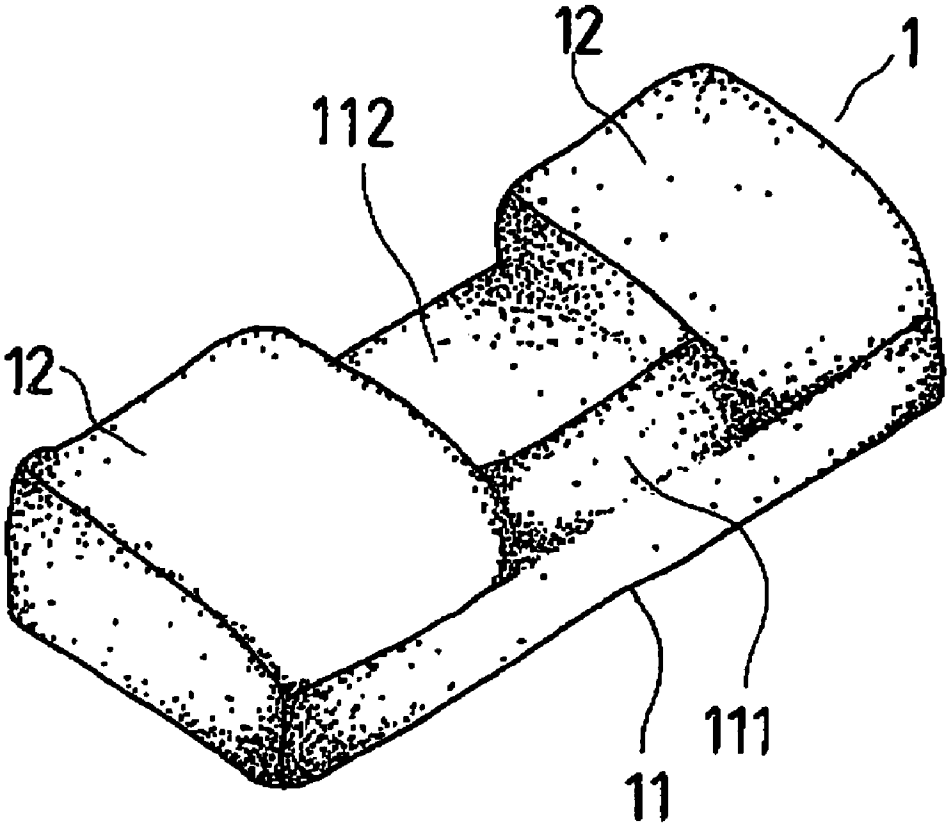
FIG. 1 (PRIOR ART)
FIG. 1 is a perspective view of the conventional pillow.
Figure 2:
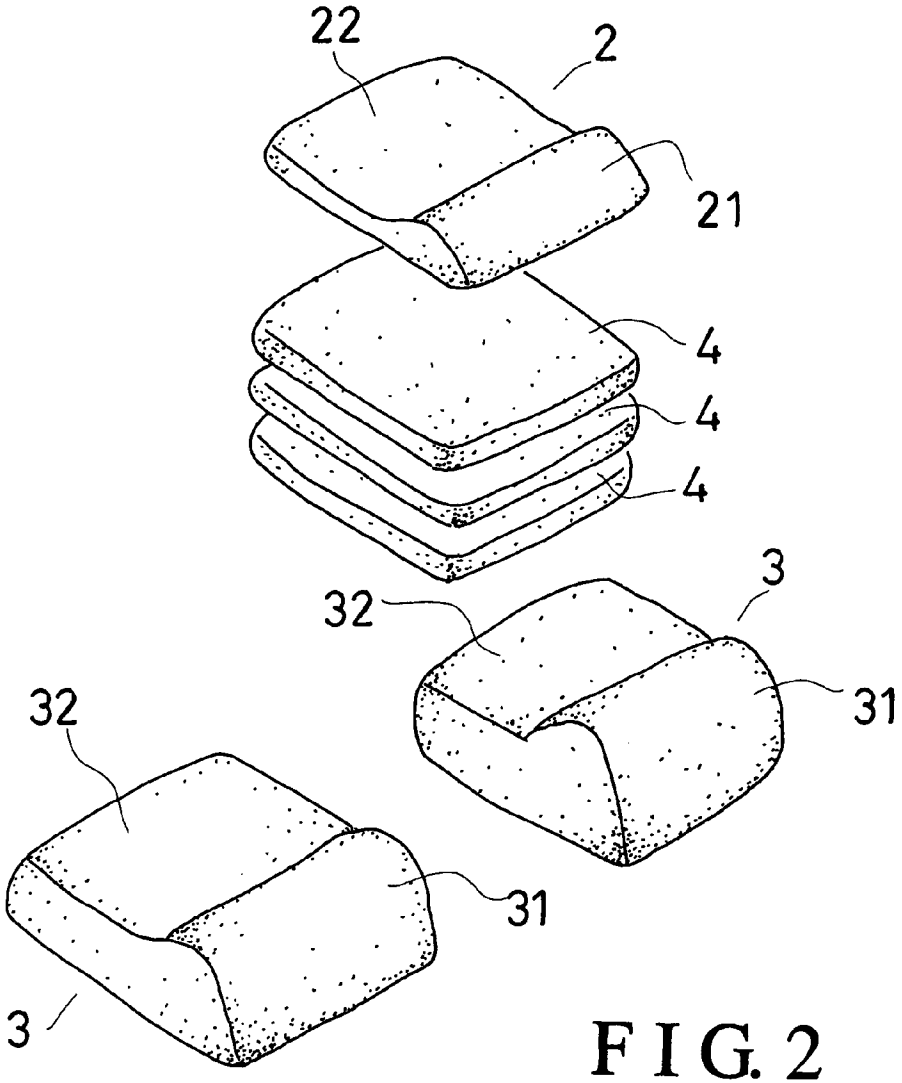
FIG. 2 is a partial exploded perspective view of a first a single bag and a pillow of embodiment of a pillow in the present invention.
Figure 3:
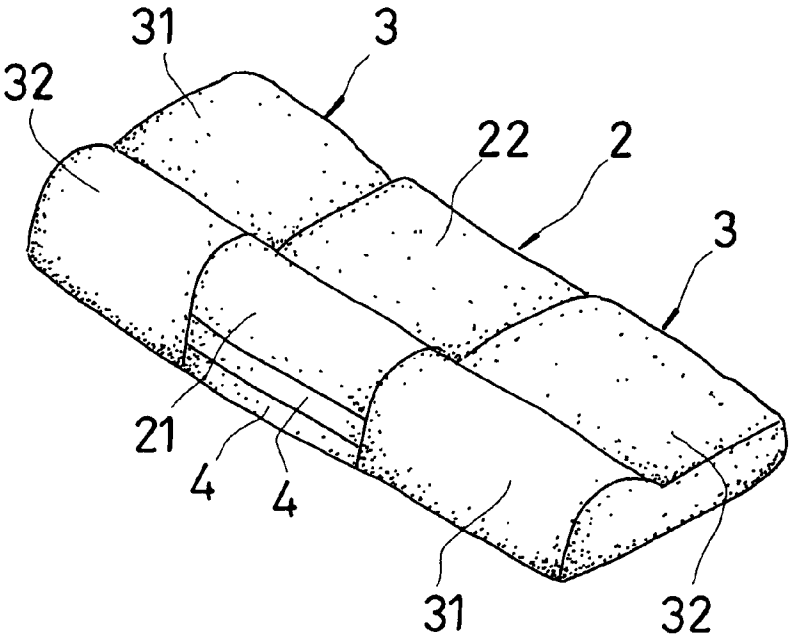
FIG. 3 is a perspective view of the first embodiment.
Figure 3:
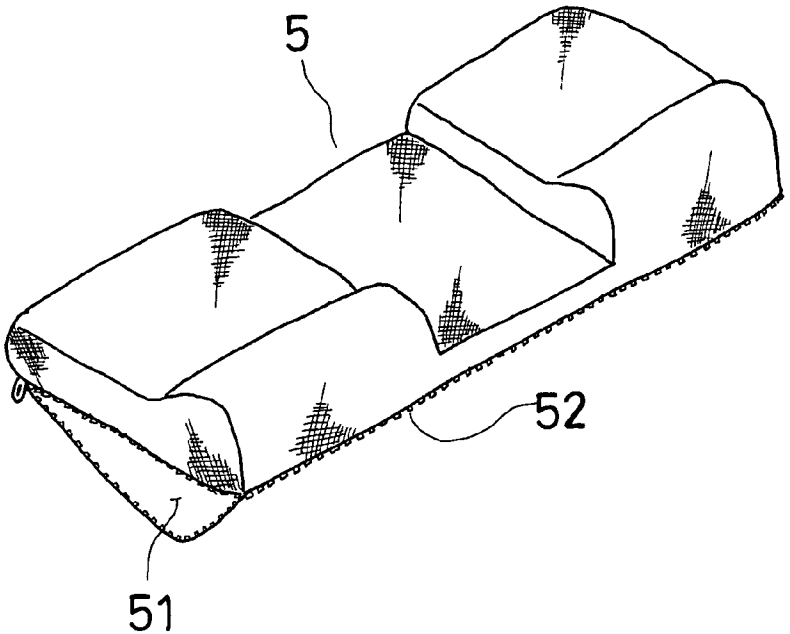

Referring to FIGS. 2 and 3, a first embodiment of a pillow includes a main support part 2, two secondary support parts 3, several mats, and a bag 5.

The main support part 2 has a convexly curved portion 21, and a lower portion 22 adjacent to the convexly curved portion 21, which portions 21 and 22 are respectively used for supporting the neck and the head of a person on.

Each of the secondary support parts 3 has a convexly curved portion 31, and a lower portion 32 adjacent to the convexly curved portion 31, which portions 31 and 32 are respectively used for supporting the neck and the head of a person on. And, the height of the secondary support parts 3 is greater than that of the main support part 2.

The mats 4 have the same width and length as the main support part 2. The mats 4 are to be positioned under the main support part 2 for raising the part 2 to a desired height according to the user's need when the main support part 2 isn't high enough.

The bag 5 has an opening 51, and a closing element 52 around the opening 51 for closing the bag 5 with. The main and the secondary support parts 2 and 3 are held in the bag 5 with the main part 2 being arranged between the secondary parts 3.

Figure 4:
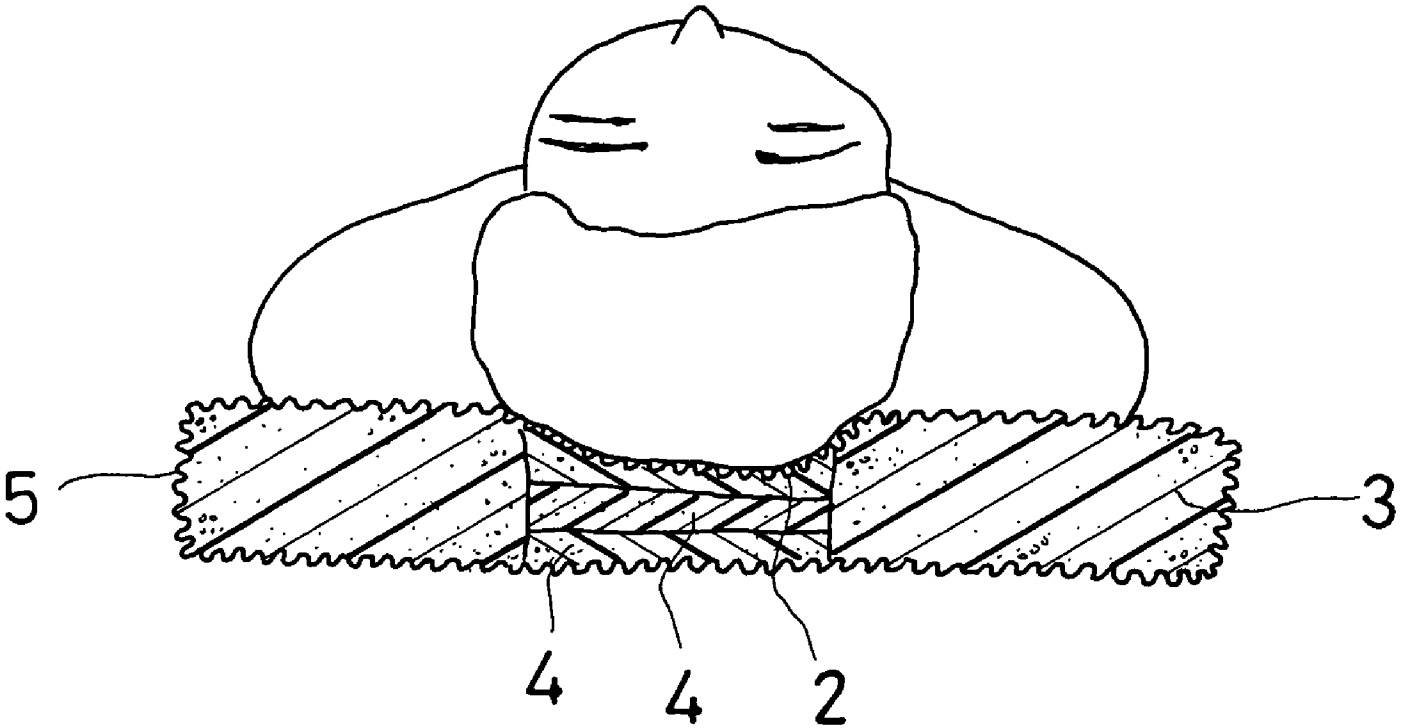
FIG. 4 is a view of the first embodiment in use.

If one wants to sleep on the back, he/she should have the neck and the head respectively supported on the convexly curved portion 21 and the lower portion 32 of the main support part 2, as shown in FIG. 4. And, if one wants to sleep on one side of the body, he/she should have the neck and the head respectively supported on the convexly curved portion 31 and the lower portion 32 of one of the secondary support parts 3. Thus, the neck and the head of the user can be supported in proper position, preventing the user from having a stiff neck.

Figure 5:
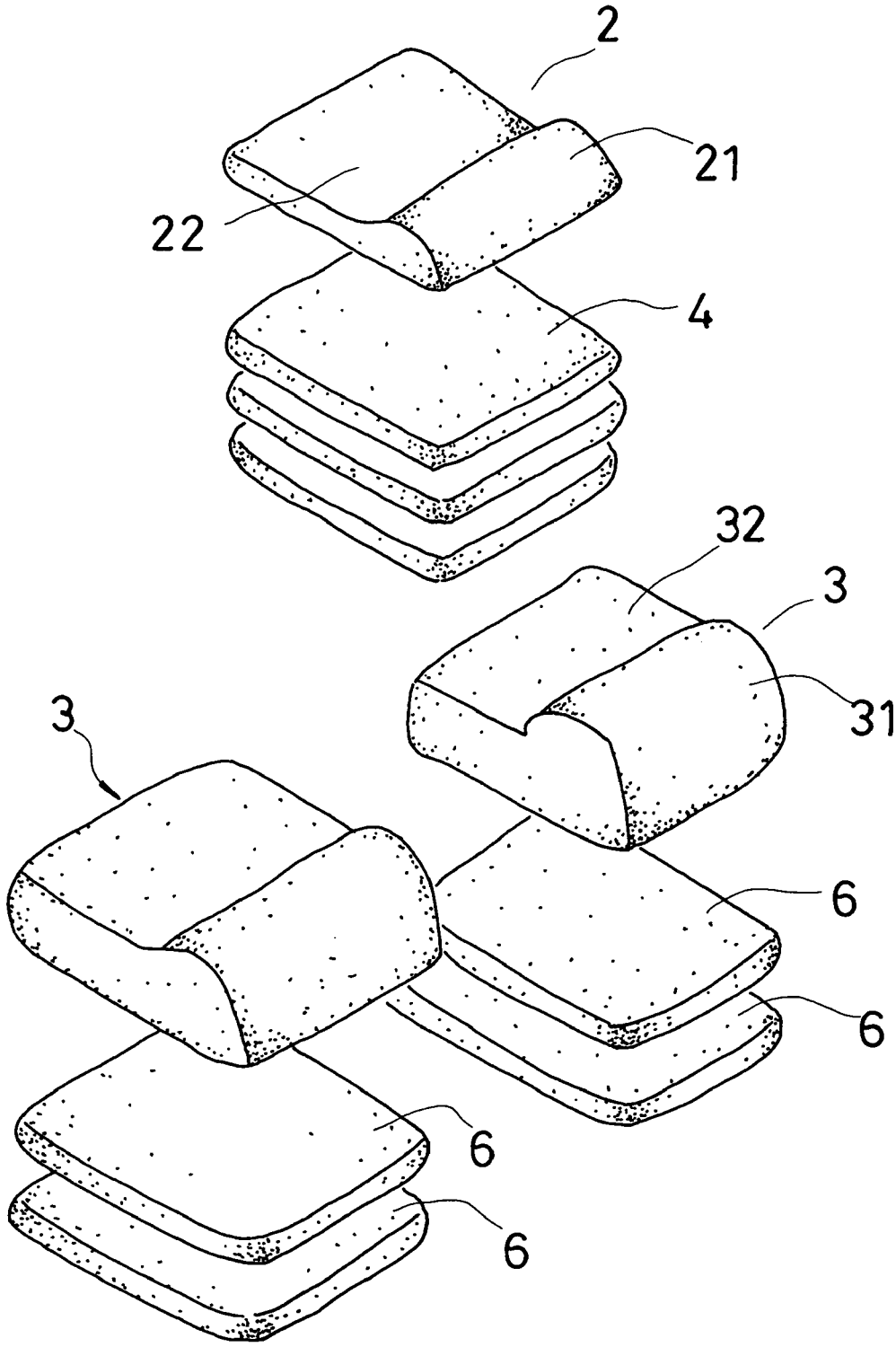
FIG. 5 is an exploded perspective view of a second embodiment of a pillow in the present invention.
Figure 6:
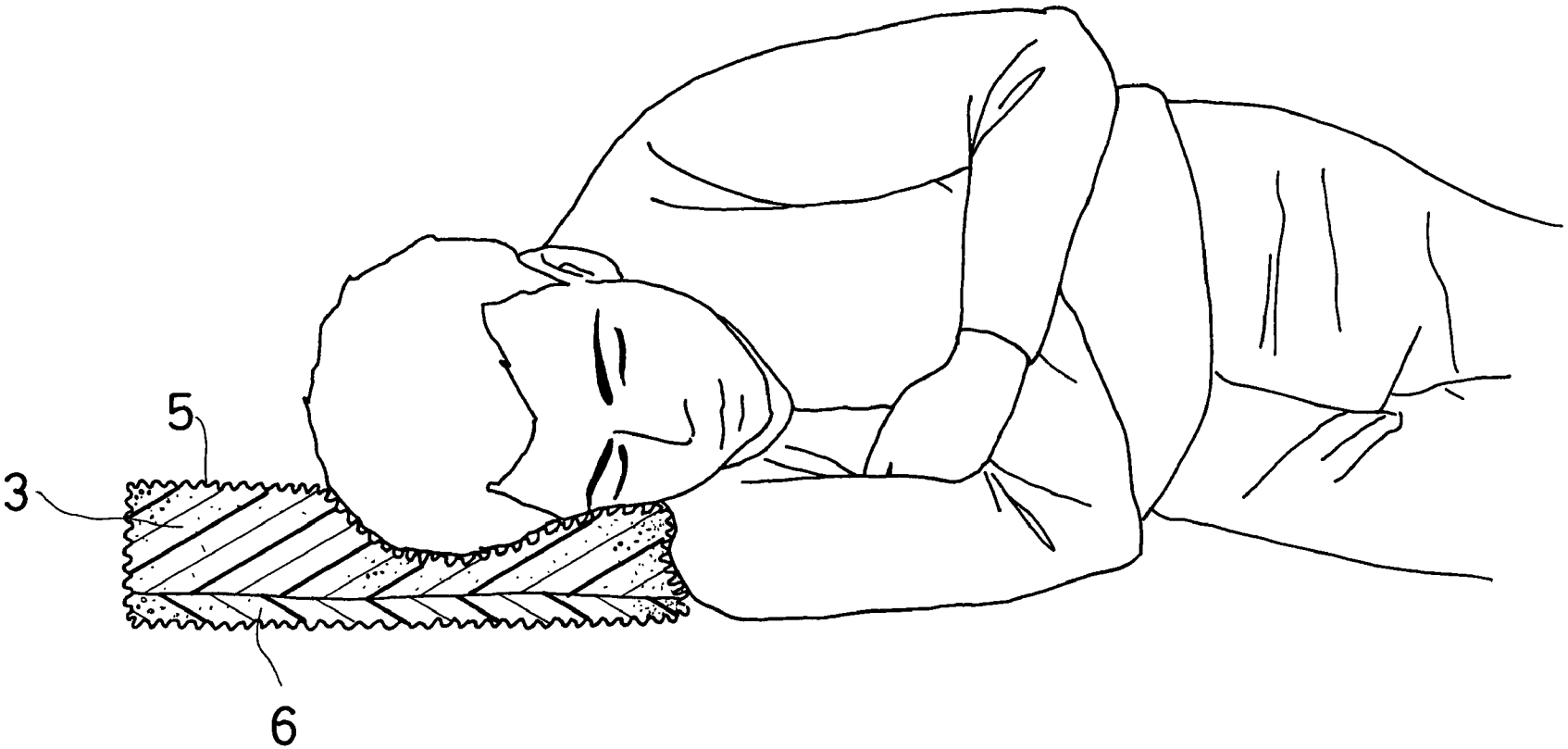
FIG. 6 is a view of the second embodiment in use.

Referring to FIGS. 5 and 6, in a second embodiment, mats 6 are provided, which are used for increasing the height of secondary support parts 3, and have the same width and length as the parts 3. Thus, when the secondary support parts 3 don't have such a height as to suit the user, they can be changed to a suitable height by means of positioning a suitable number of mats 6 under them, and changing the number of mats 6 under them.

As seen in the figures, the support parts are generally rectangularly shaped, with the convex portions adjacent one of the sides of the support parts, and disposed in a linearly aligned relationship.

From the above description, it can be easily understood that the pillow of the present invention has the following advantages:

1. The pillow has the secondary support parts besides the main support part therefore a user can have the neck and the head supported in proper position not only when he/she sleeps on the back, but also when he/she sleeps on one side. And, the user can adjust the heights of the main and the secondary support parts according to the body size, thus having good quality sleep.

2. The pillow can be restored to the suitable height by means of the mats when the main and the secondary support parts become thin because of use for a period of time. Therefore, the pillow has long service life, economical to use.

3. The mats can be easily positioned into the bag, and the pillow is convenient to use.

What is claimed is:

1. A pillow, comprising a generally rectangular main support part having a raised convexly curved portion adjacent one of its sides and a substantially planar lower portion;

a plurality of mats positioned under the main support part for changing a height of the main support part, the mats having a same width and length as the main support part;

two generally rectangular secondary support parts positioned on two sides of the main support part, each of the secondary support parts having a greater height than the main support part, each of the secondary support parts having a raised convexly curved portion adjacent one of its sides and a substantially planar lower portion; and a bag having a single chamber housing the main support part, the mats, and the secondary support parts therein, the raised convexly curved portion of the secondary support parts being disposed in a linearly aligned relationship with the raised convexly curved portion of the main support part, the bag having an opening for the support parts and the mats to be passed through into the chamber.

2. The pillow as claimed in claim 1, wherein the bag has a closing element around the opening for closing the bag with.

3. The pillow as claimed in claim 1, wherein the secondary support part has a plurality of mats positioned under it.

* * * * *